US007131415B2

(12) United States Patent
Enokida et al.

(10) Patent No.: US 7,131,415 B2
(45) Date of Patent: Nov. 7, 2006

(54) RESIN INTAKE MANIFOLD FOR MULTICYLINDER ENGINE

(75) Inventors: Satoshi Enokida, Hiroshima (JP); Yutaka Miyahara, Hiroshima (JP)

(73) Assignee: GP Daikyo Corporation, Hiroshima (JP)

( * ) Notice: Subject to any disclaimer, the term of this patent is extended or adjusted under 35 U.S.C. 154(b) by 0 days.

(21) Appl. No.: 11/190,895

(22) Filed: Jul. 28, 2005

(65) Prior Publication Data

US 2006/0037575 A1 Feb. 23, 2006

(30) Foreign Application Priority Data

Aug. 19, 2004 (JP) ..... 2004-239317

(51) Int. Cl.
*F02M 35/104* (2006.01)

(52) U.S. Cl. ..... 123/184.24; 123/184.61

(58) Field of Classification Search ..... 123/184.24, 123/184.34, 184.42, 184.47
See application file for complete search history.

(56) References Cited

U.S. PATENT DOCUMENTS 6,192,849 B1 * 2/2001 Powell ..... 123/184.34
6,467,449 B1 * 10/2002 Brassell et al. ..... 123/184.61
6,604,500 B1 * 8/2003 Miyahara et al. ..... 123/184.61
6,644,260 B1 * 11/2003 Tsukii et al. ..... 123/184.42
2003/0172894 A1 * 9/2003 Iwata et al. ..... 123/184.42
2004/0123826 A1 * 7/2004 Yamamoto et al. .... 123/184.44

FOREIGN PATENT DOCUMENTS

JP 2002-070670 3/2002
JP 2002-235619 8/2002

* cited by examiner

*Primary Examiner*—Marguerite McMahon
(74) *Attorney, Agent, or Firm*—Nixon Peabody LLP; Donald R. Studebaker

(57) ABSTRACT

An intake manifold is assembled from a near manifold component which is positioned near an engine, a far manifold component which is positioned far from the engine and a middle manifold component which is positioned between the near and far manifold components. The near manifold component includes first path-forming parts forming the lower parts of the intake paths. The middle manifold component includes second path-forming parts which are joined on and vibration-welded to the first path-forming parts. The middle manifold component further includes third path-forming parts which extend in the vertical direction in a curve. Further, the far manifold component includes fourth path-forming parts which are vibration-welded to the third path-forming parts.

4 Claims, 7 Drawing Sheets

RESIN INTAKE MANIFOLD FOR MULTICYLINDER ENGINE

CROSS-REFERENCE TO RELATED APPLICATION

This non-provisional application claims priority under 35 U.S.C. §119(a) on Patent Application No. 2004-239317 filed in Japan on Aug. 19, 2004, the entire contents of which are hereby incorporated by reference.

BACKGROUND OF THE INVENTION (a) Field of the Invention

The present invention relates to a resin intake manifold for feeding air to intake ports of a multicylinder engine.

(b) Description of Related Art

As disclosed by Japanese Unexamined Patent Publications Nos. 2002-235619 (Patent Literature 1) and 2002-70670 (Patent Literature 2), there has been known a resin intake manifold including a plurality of intake paths connected to individual intake ports of an inline multicylinder engine. If a resin is used to form the intake manifold as disclosed by these patent literatures, the shape of the intake manifold can be designed with a high degree of freedom. Therefore, a throttle body mounting part for mounting a throttle body having a throttle valve and a surge tank can be integrated with the intake paths.

The resin intake manifold of Patent Literature 1 is formed of a combination of four manifold components. One of the manifold components to be mounted to the engine is configured to extend downward with inclination from the engine to the direction away from the engine. On the top of the manifold component attached to the engine, another manifold component which constitutes part of the intake paths is welded and the throttle body mounting part is integrated with the welded manifold component. Further, the other two manifold components which constitute the surge tank and part of the intake paths are welded to the bottom of the manifold component attached to the engine.

On the other hand, the resin intake manifold of Patent Literature 2 is formed of a combination of three manifold components which are separated in the vertical direction. Among them, the top manifold component is attached to the engine and integrated with the throttle body mounting part. The other two manifold components are welded below the top manifold component.

Since the intake manifold is fixed to the engine, the vibration of the engine is directly transmitted to every part of the intake manifold. Therefore, if the intake manifold is formed by welding a plurality of resin manifold components together as disclosed by Patent Literature 1, they must be welded firmly enough not to be separated from each other. However, according to Patent Literatures 1 and 2, the bottom side of the manifold component attached to the engine and the top side of another manifold component are welded together. Therefore, the weight of the lower manifold component is exerted downward on the welding interface between the manifold component attached to the engine and the lower manifold component, i.e., force is applied in the direction in which the manifold components are separated. Thus, there is a difficulty in maintaining a welding strength of a satisfactory degree.

Further, since the intake manifold of Patent Literature 1 is formed of four manifold components, the number of steps of welding the manifold components increases, causing a problem in mass productivity.

SUMMARY OF THE INVENTION

The present invention has been achieved in view of the above-described problems. An object of the present invention is to provide a firm intake manifold by giving a twist to the way of separating the intake manifold into parts and the configuration of the separated manifold components so that the manifold components are welded at high strength.

To achieve the above object, the present invention provides a resin intake manifold for a multicylinder engine including a throttle body mounting part to which a throttle body is attached, a surge tank and intake paths which communicate with intake ports of the multicylinder engine, the throttle body, the surge tank and the intake paths being arranged in sequence along the direction of intake air flow, the intake paths extending in a curve from the bottom of the surge tank in the direction away from the engine and then upward to the intake ports of the multicylinder engine along the direction of the intake air flow, wherein the intake manifold comprises an assembly of separate components including: a near manifold component which is positioned near the engine; a far manifold component which is positioned at the side of the near manifold component opposite to the engine; and a middle manifold component which is positioned between the near and far manifold components, the near manifold component comprises a mounting part to be fixed to the engine, a first tank part which is positioned below the mounting part and constitutes part of the surge tank near the engine, and first path-forming parts which extend from the bottom of the first tank part in the direction away from the engine and constitute lower parts of the upstream sides of the intake paths, the middle manifold component comprises a second tank part which is joined to the side of the first tank part opposite to the engine to form the surge tank together with the first tank part, second path-forming parts which are joined on the first path-forming parts to form the upstream sides of the intake paths together with the first path-forming parts, and third path-forming parts which constitute engine-side parts of the downstream sides of the intake paths extending in the vertical direction in a curve to bulge in the direction away from the engine, the far manifold component comprises fourth path-forming parts which are joined to the sides of the third path-forming parts opposite to the engine to form the downstream sides of the intake paths together with the third path-forming parts, the middle manifold component or the far manifold component is formed integrally with the throttle body mounting part communicating with the surge tank, and the near manifold component, the middle manifold component and the far manifold component are integrated together such that the first and second tank parts are welded, the first and second path-forming parts are welded and the third and fourth path-forming parts are welded.

According to this configuration, the second tank part of the middle manifold component is welded to the first tank part of the near manifold component to form the surge tank. Further, the second path-forming parts of the middle manifold component are jointed on and welded to the first path-forming parts of the near manifold component to form the upstream sides of the intake paths. Likewise, the fourth path-forming parts of the far manifold component are welded to the third path-forming parts of the middle manifold components to form the downstream sides of the intake paths. Then, the intake manifold is mounted on the engine by attaching the mounting part of the near engine part to the engine.

Where the intake manifold is mounted on the engine, the second path-forming parts of the middle manifold component are jointed on the first path-forming parts of the near manifold component. Therefore, the weight of the middle manifold component is applied to press the second path-forming parts against the first path-forming parts, i.e., it is not applied in such a direction that the first and second path-forming parts separate from each other. Thus, the welding strength between the first and middle manifold components is ensured. Further, since the third path-forming parts of the middle manifold component and the fourth path-forming parts of the far manifold component constitute vertically curved portions of the intake paths, the welding interface between the third and fourth path-forming parts also extends in the vertical direction in a curve. Therefore, the weight of the far manifold component is applied to shear the welding interface. As a result, unlike the conventional intake manifold in which the weight of the manifold component is applied to separate the welded manifold components, the intake manifold of the present invention ensures the welding strength. The configuration of the manifold components allows obtaining satisfactory welding strength among the manifold components, thereby making the intake manifold firm.

Further, according to the present invention, the intake manifold is assembled from three separate manifold components. Therefore, as compared with the conventional intake manifold which is formed of four manifold components as disclosed by Patent Literature 1, parts count decreases to reduce the number of the manufacturing steps, thereby improving mass productivity.

As to the above-described resin intake manifold, the intake paths may be aligned in the direction of the arrangement of cylinders of the engine such that adjacent pairs of the intake paths are spaced from each other in the direction of the cylinder arrangement, the far manifold component may be provided with a connection wall which connects the fourth path-forming parts forming the intake paths spaced from each other in the direction of the cylinder arrangement and the throttle body mounting part of cylindrical shape which penetrates the connection wall, and the connection wall may be joined on the outer surface of the second tank part of the middle manifold component and the second tank part has an air inlet through which the inside of the throttle body mounting part communicates with the surge tank.

By so doing, the connection wall is jointed on the second tank part to form a double layered structure, thereby improving the rigidity of the throttle body mounting part. Therefore, the throttle body mounting part is not broken even if a heavy throttle body is attached thereto.

The vertical cross section of the near manifold component may substantially be L-shaped. By designing the vertical cross section of the near manifold component as described above, the near manifold component increases in rigidity. As a result, the intake manifold is made firmer.

DETAILED DESCRIPTION OF THE INVENTION

Hereinafter, with reference to the drawings, a detailed explanation is given of embodiments of the present invention. The following explanation of preferable embodiments is merely exemplary in nature and does not limit the present invention, objects to which the invention is applied and use of the invention.

(Embodiment 1)

Figure 1:
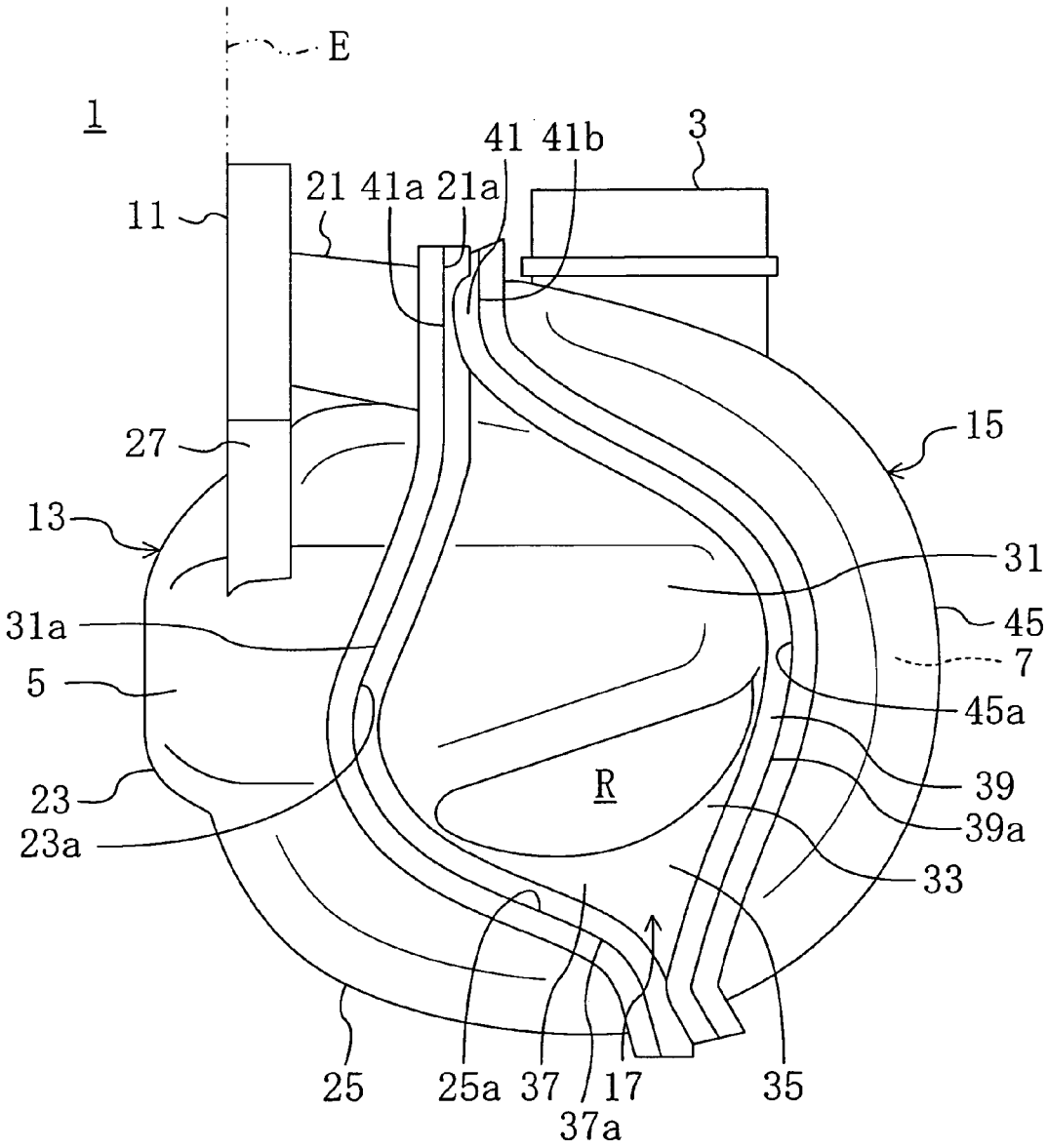
FIG. 1 is a side view of an intake manifold of Embodiment 1.

FIG. 1 shows a resin intake manifold 1 for a multicylinder engine according to Embodiment 1 of the present invention. The intake manifold 1 is mounted on an inline four-cylinder engine E including four cylinders connected in line. The intake manifold 1 is made of a resin and includes integral parts of: a cylindrical throttle body mounting part 3 to which a throttle body (not shown) having a throttle valve is attached; a surge tank 5 which communicates with the inside of the throttle body mounting part 3; and four individual intake paths 7 which communicate with the surge tank 5 and intake ports (not shown) of the cylinders.

Figure 5:
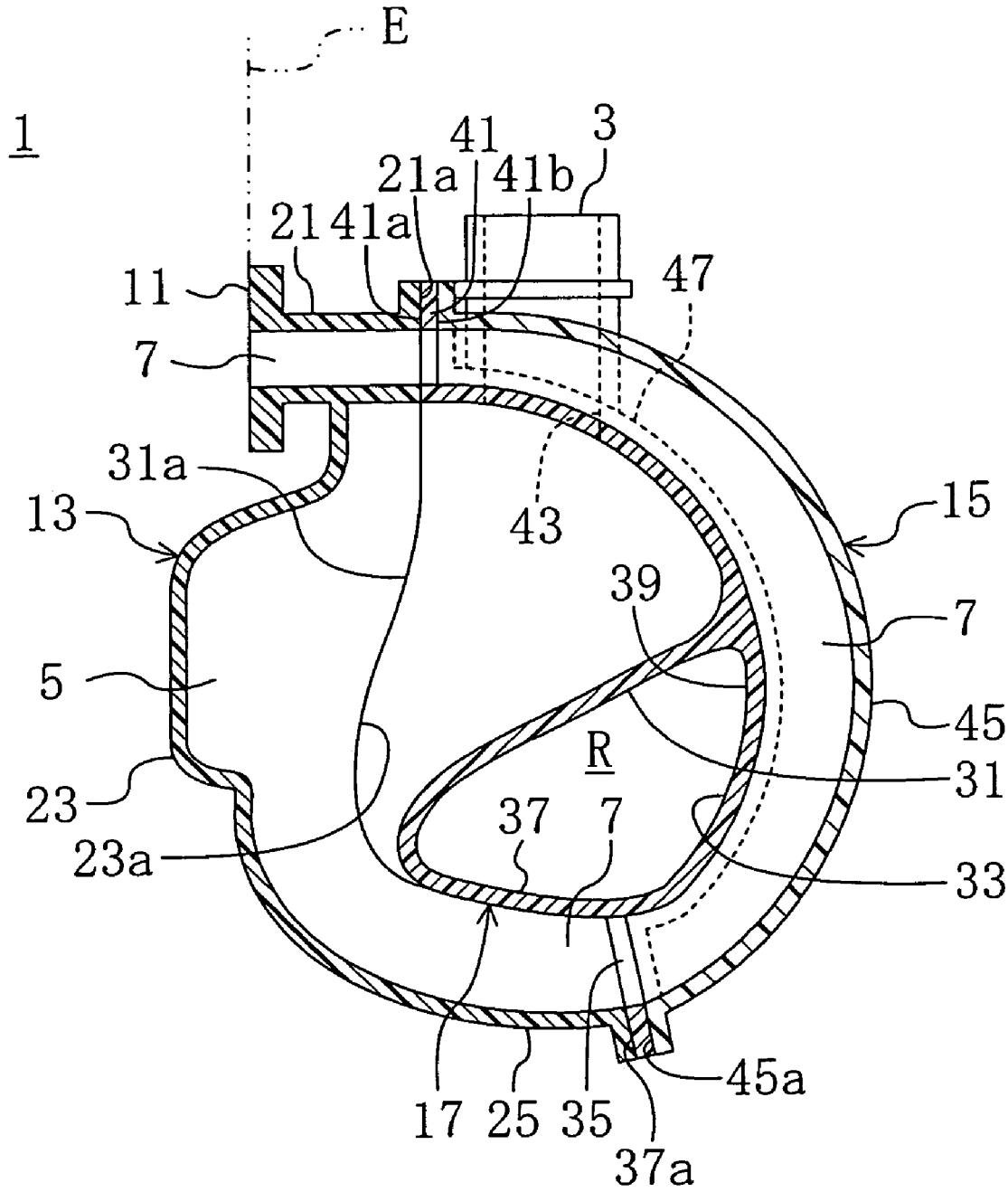
FIG. 5 is a longitudinal cross section of the intake manifold.

The surge tank 5 is located substantially at the vertical center of the intake manifold 1. The throttle body mounting part 3 is provided at the top of the surge tank 5. The four intake paths 7 are aligned in the direction of the arrangement of the cylinders of the engine E. As seen in FIG. 5, the upstream ends of the intake paths 7 are connected to the bottom surface of the surge tank 5 so that the intake paths 7 communicate with the inside of the surge tank 5. The upstream sides of the intake paths 7 extend downward in a curve from the bottom of the surge tank 5 in the direction away from the engine E. The downstream sides of the intake paths 7 extend upward in a curve at the side of the surge tank 5 opposite to the engine E and then extend in a curve toward the engine E. The upstream sides of the intake paths 7 are adjacent to each other, while the downstream sides thereof are spaced from each other to correspond with the spaced arrangement of the cylinders of the engine E.

At the downstream ends of the intake paths 7, a flange 11 is provided as a mounting part to be fixed to the side surface of the engine E. The intake manifold 1 is mounted on the engine E via the flange 11. Where the intake manifold 1 is mounted on the engine E, intake air is introduced into the surge tank 5 from the throttle body through the throttle body mounting part 3. The intake air flown into the surge tank 5 is distributed to the intake paths 7 and fed to the intake ports of the engine E.

Figure 6:
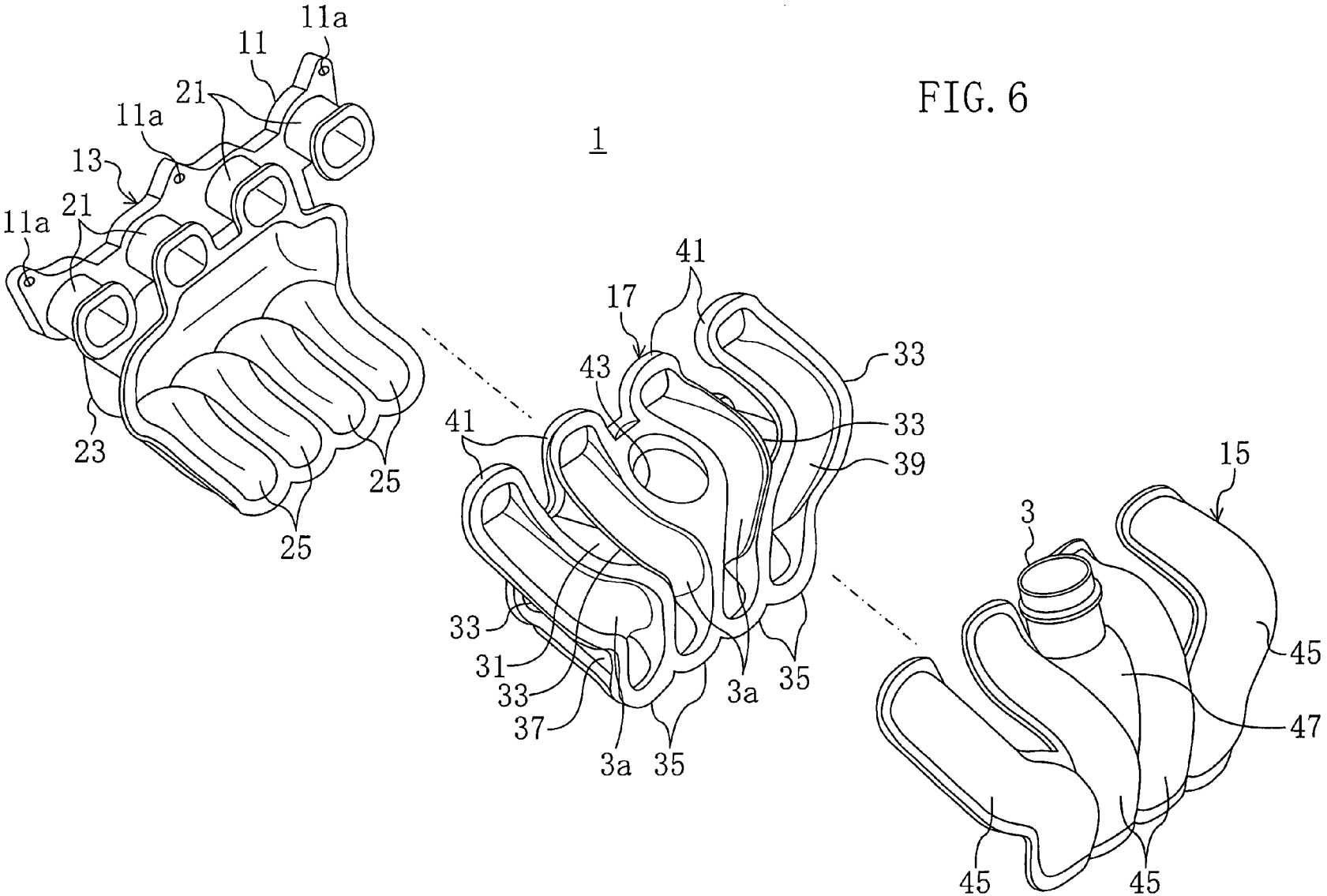
FIG. 6 is an exploded oblique view of the intake manifold.

As shown in FIG. 6, the intake manifold 1 is assembled from three separate components, namely, a near manifold component 13 which is positioned near the engine E, a far manifold component 15 which is positioned far from the engine E and a middle manifold component 17 which is positioned between the near and far manifold components 13 and 15. The manifold components 13, 15 and 17 are injection molded resin products.

Figure 2:
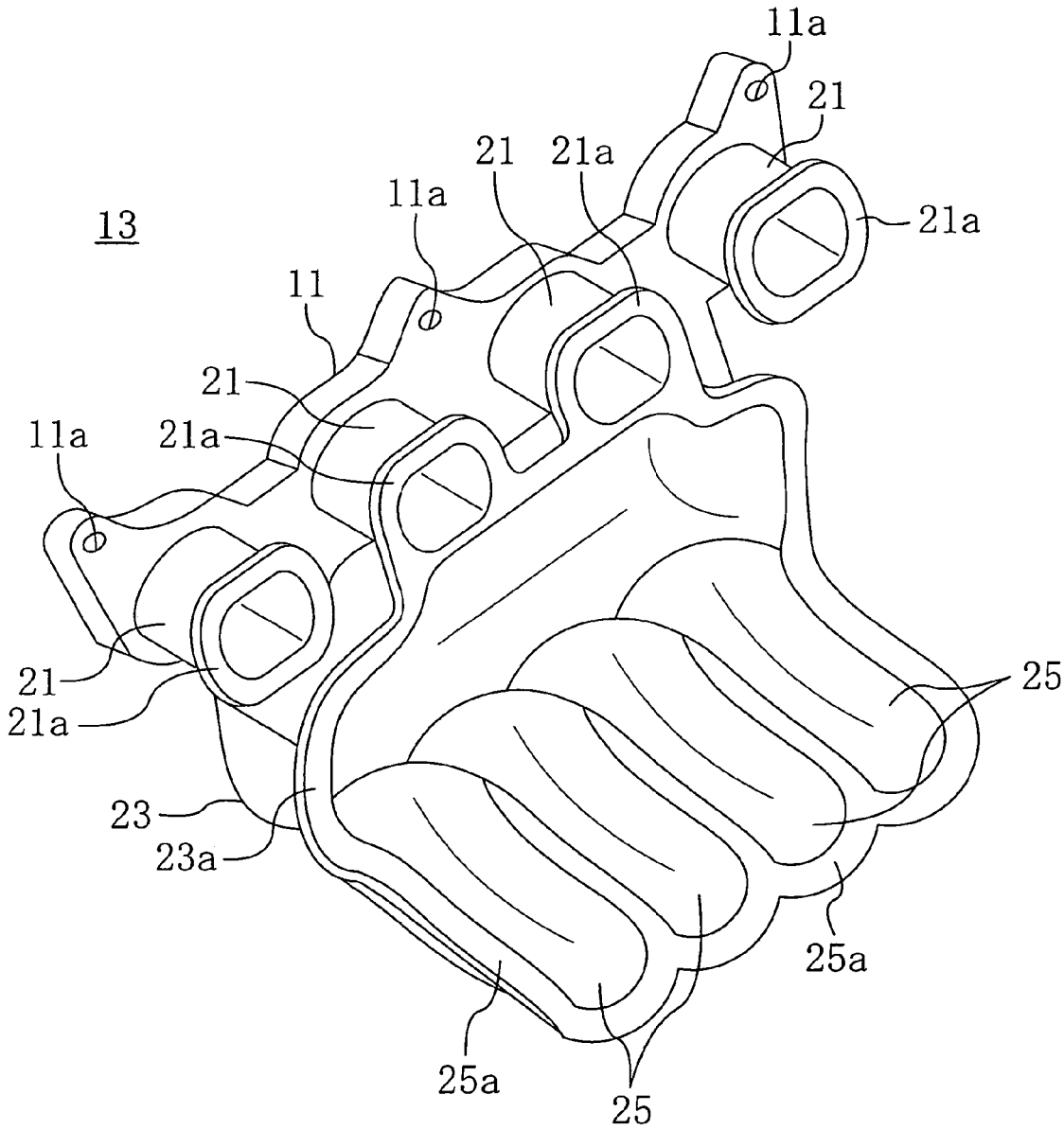
FIG. 2 is an oblique view of a near manifold component.

As shown in FIG. 2, the near manifold component 13 includes integral parts of: the flange 11; four downstream end parts 21 which constitute parts of the intake paths 7 near the downstream ends thereof; a first tank part 23 which constitute part of the surge tank 5 near the engine E; and four first path-forming parts 25 which constitute the lower parts of the upstream sides of the intake paths 7. The flange 11 is in the form of a thick plate which extends in the vertical direction along the side surface of the engine E. A plurality of insertion holes 11*a* are provided at the periphery of the flange 11 so that fastening means (not shown) are inserted therein. As shown in FIG. 1, the bottom of the flange 11 is connected to the vicinity of the top surface of the surge tank 5 via a connector 27 so that the rigidity of the flange 11 is ensured.

Each of the downstream end parts 21 is substantially in the form of a cylinder which protrudes from the flange 11 in the direction away from the engine E. The downstream end parts 21 are spaced from each other along the direction of the arrangement of the intake paths 7. The intake paths 7 communicate with intake ports (not shown) of the engine E via the downstream end parts 21. At the end thereof opposite to the engine E, the downstream end parts 21 are provided with a welding plane 21*a* so that the middle manifold component 17 is vibration-welded thereto.

The first tank part 23 is configured to bulge toward the engine E beyond the flange 11. The vertical cross section of the first tank part 23 is substantially in the form of horizontally oriented U having an opening toward the direction away from the engine E, and so is the horizontal cross section thereof. That is, the first tank part 23 is substantially in the form of a rectangular bowl. A welding plane 23*a* which is continuous from the welding plane 21*a* is provided at the periphery of the first tank part 23 so that the middle manifold component 17 is vibration-welded thereto.

Each of the first path-forming parts 25 is depressed downward and extends continuously from the lower part of the first tank part 23 in the direction away from the engine E. Therefore, with the thus configured first tank part 23 and the first path-forming parts 25, the near manifold component 13 is substantially L-shaped when viewed in vertical section as shown in FIG. 5. The first path-forming parts 25 are arranged side by side in the direction of the arrangement of the intake paths 7 and therefore the lower part of the near manifold component 13 is generally corrugated. A welding plane 25*a* is provided at the upper ends of the first path-forming parts 25 and the edges thereof on the side far from the engine E so that the middle manifold component 17 is vibration-welded thereto. The welding plane 25*a* at the upper ends of the first path-forming parts 25 is continuous from the welding plane 23*a*.

Figure 3:
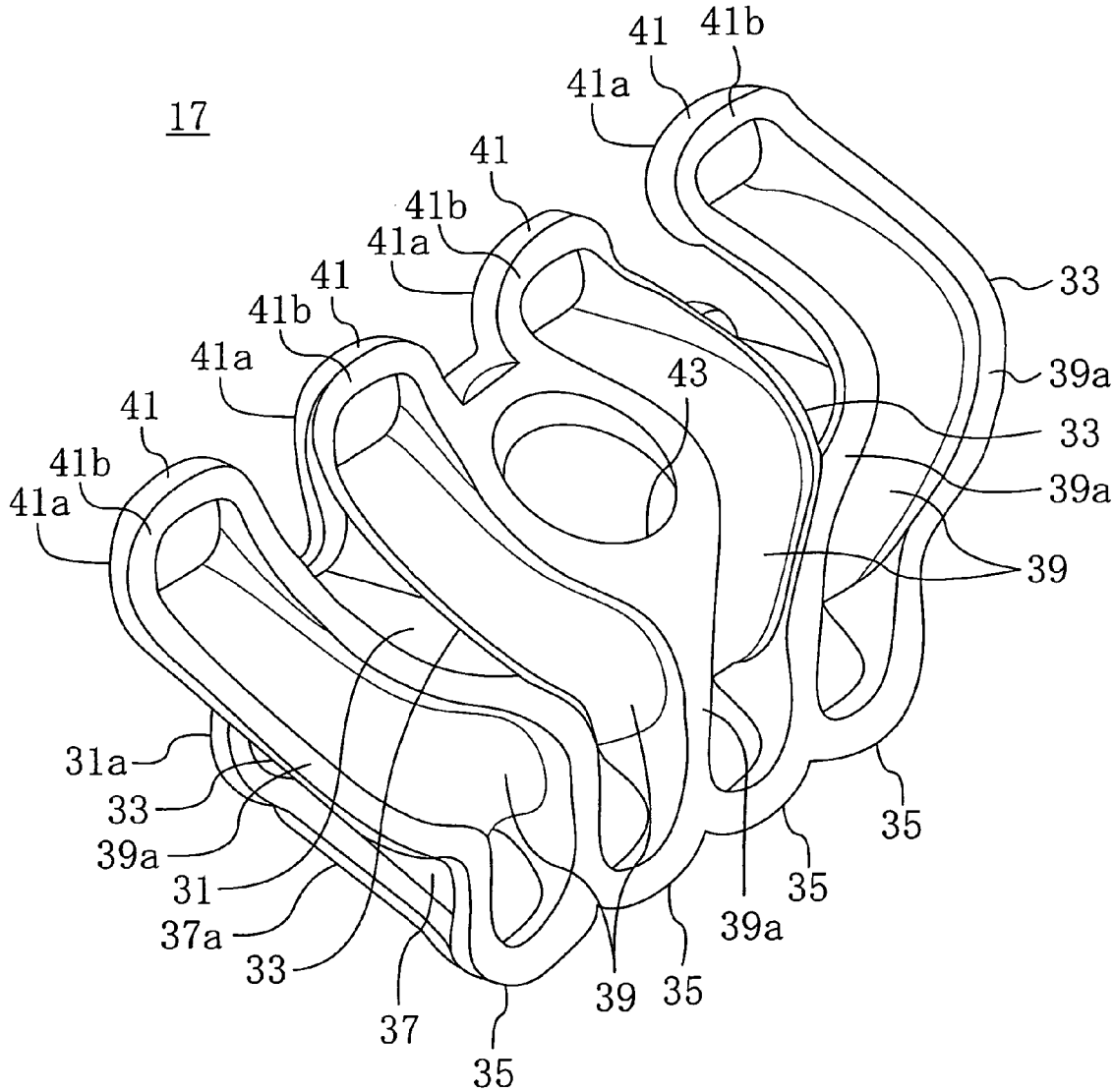
FIG. 3 is an oblique view of a middle manifold component.

The middle manifold component 17 includes, as shown in FIGS. 1 and 5, a second tank part 31 which constitutes part of the surge tank 5 far from the engine E and four curved portions 33 which are curved along the direction of extension of the intake paths 7 as shown in FIG. 3. The vertical cross section of the second tank part 31 is substantially in the form of horizontally oriented U having an opening toward the engine E to meet the first tank part 23, and so is the horizontal cross section thereof. At the periphery of the second tank part 31, a welding plane 31*a* which is vibration-welded to the welding plane 23*a* of the first tank part 23 is provided.

The upper parts of the outside two of the four curved portions 33 aligned in the direction of the arrangement of the intake paths 7 are spaced from the outer surface of the second tank part 31. On the other hand, the inside two curved portions 33 are so configured that horizontally extending lower parts thereof corresponding to the upstream sides of the intake paths 7 are spaced downward from the bottom surface of the second tank part 31, while horizontally oriented upper parts thereof corresponding to the downstream sides of the intake paths 7 are integrally formed with the top surface of the second tank part 31. Therefore, space R extending along the direction of the arrangement of the intake paths 7 is provided between the bottom surface of the second tank part 31 and the curved portions 33.

At parts of the curved portions 33 corresponding to the upstream sides of the intake paths 7, lower ring-shaped parts 35 are integrally formed to extend downward to constitute parts of the intake paths 7. Parts of the curved portions 33 which are on the upstream side of the intake paths 7 from the lower ring-shaped parts 35 are defined as second path-forming parts 37. The second path-forming parts 37 are joined on the first path-forming parts 25 of the near manifold component 13 to form the upstream sides of the intake paths 7 together with the first path-forming parts 25. At the periphery of the second path-forming parts 37, a welding plane 37*a* which is vibration-welded to the welding plane 25*a* of the first path-forming parts 25 is provided.

As shown in FIG. 3, parts of the curved portions 33 which are on the downstream side of the intake paths 7 from the lower ring-shaped parts 35 are defined as third path-forming parts 39 which constitute the engine-side parts of the intake paths 7 extending in the vertical direction in a curve to bulge in the direction away from the engine E. As shown in FIG. 1, after extending upward at the side of the second tank part 31 far from the engine E, the third path-forming parts 39 extend to reach the downstream end parts 21 of the near manifold component 13. At the periphery of the third path-forming parts 39, a welding plane 39*a* which is vibration-welded to the far manifold component 15 is provided.

At the ends of the curved portions 33 on the downstream side of the intake paths 7, upper ring-shaped parts 41 are integrally formed to protrude upward to constitute part of the intake paths 7. On the side of the upper ring-shaped parts 41 near the engine E, a welding plane 41*a* which is vibration-welded to the welding plane 21*a* of the downstream end parts 21 is provided. Further, on the side of the upper ring-shaped parts 41 opposite to the engine E, a welding plane 41*b* which is vibration-welded to the far manifold component 15 is provided. The welding planes 41*a* and 41*b* are continuous from the welding planes 31*a* and 39*a*, respectively.

The upper parts of the two inside ones of the four curved portions 33 are spaced from each other in the direction of the arrangement of the intake paths 7. Further, as shown in FIG. 5, in the top surface of the second tank part 31 located between the two inside curved portions 33, an air inlet 43 is formed to communicate with the inside of the throttle body mounting part 3.

Figure 4:
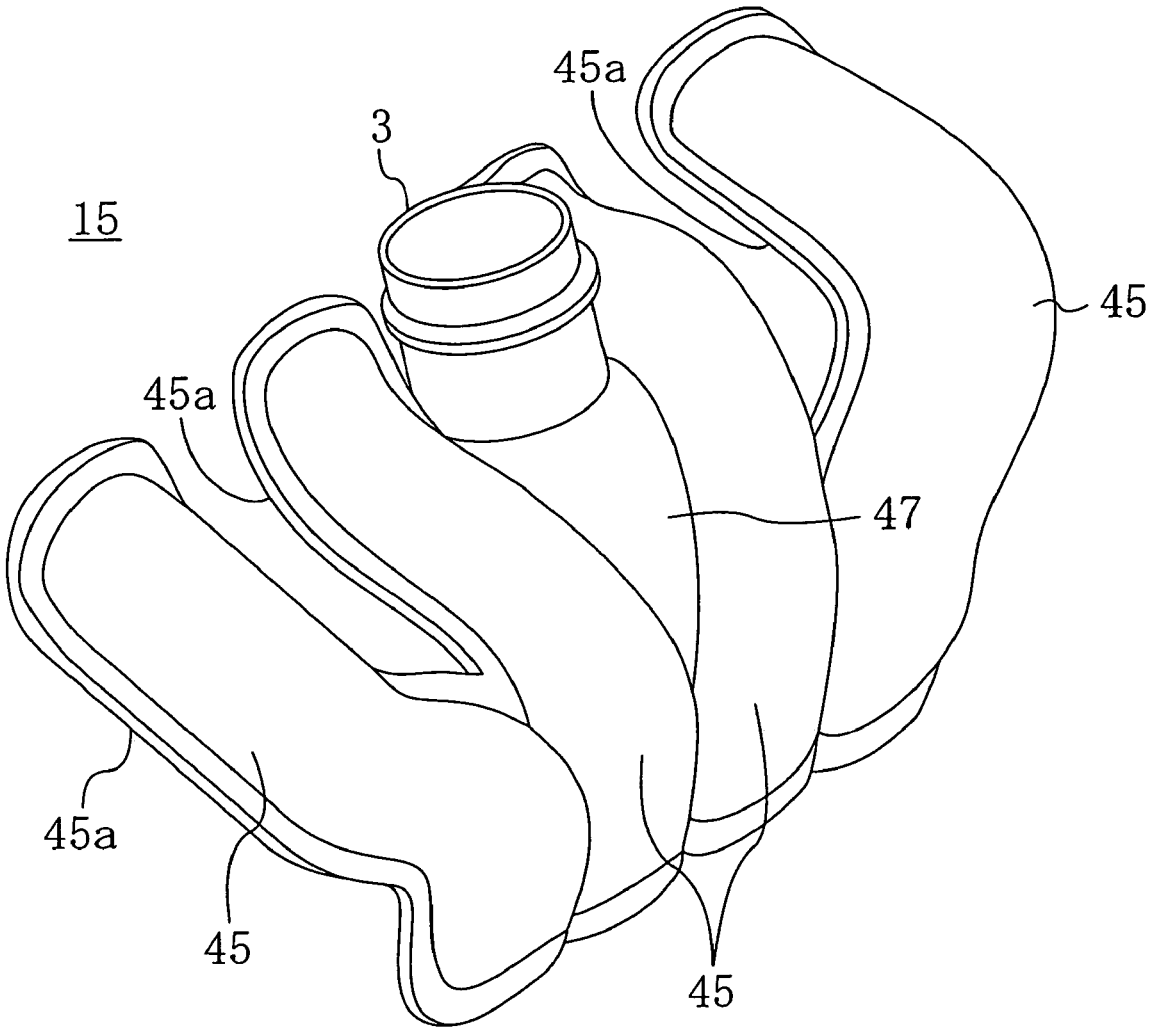
FIG. 4 is an oblique view of a far manifold component.

As shown in FIG. 4, the far manifold component 15 includes four fourth path-forming parts 45 which are joined to the sides of the third path-forming parts 39 opposite to the engine E to constitute the downstream sides of the intake paths 7 together with the third path-forming parts 39. Each of the four fourth path-forming parts 45 is substantially U-shaped when viewed in vertical cross section and substantially semicircular when viewed in horizontal cross section. At the periphery of the fourth path-forming parts 45, a welding plane 45*a* which is vibration-welded to the welding plane 39*a* of the third path-forming parts 39 and the welding plane 41*a* of the upper ring-shaped parts 41 is provided.

Each of the fourth path-forming parts 45 extends substantially in the vertical direction and the vertical middle part thereof is curved to bulge in the direction away from the engine E. The lower parts of the fourth path-forming parts 45 are adjacent to each other and integrated, while the upper parts thereof are spaced from each other along the direction of the arrangement of the intake paths 7. Between the two inside ones of the four fourth path-forming parts 45 aligned in the direction of the arrangement of the intake paths 7, a connection wall 47 is provided to connect the two inside fourth path-forming parts 45. The connection wall 47 is joined on the outer surface of the second tank part 31 of the middle manifold component 17.

The throttle body mounting part 3 is integrally formed with the connection wall 47 to extend in the vertical direction. As shown in FIG. 5, the lower end of the throttle body mounting part 3 is connected to the connection wall 47 to form an opening. The opening at the lower end of the throttle body mounting part 3 is coincident with the air inlet 43 of the second tank part 31 so that the inside of the throttle body mounting part 3 communicates with the surge tank 5 via the air inlet 43.

Now, an explanation is given of how the intake manifold 1 configured as described above is fabricated. First, with a vibration welding machine (not shown), the welding planes 21*a*, 23*a* and 25*a* of the near manifold component 13 and the welding planes 41*a*, 31*a* and 37*a* of the middle manifold component 17 are brought into contact under pressure and one of the manifold components is vibrated with respect to the other. By so doing, the first tank part 23 and the second tank part 31 are vibration-welded to form the surge tank 5, while the first path-forming parts 25 and the second path-forming parts 37 joined thereon are vibration-welded to form the upstream sides of the intake paths 7. Then, using the vibration welding machine, the welding planes 39*a* and 41*b* of the middle manifold component 17 and the welding plane 45*a* of the far manifold component 15 are brought into contact under pressure and one of the manifold components is vibrated with respect to the other. By so doing, the third path-forming parts 39 and the fourth path-forming parts 45 joined thereto are vibration-welded to form the downstream sides of the intake paths 7. Thus, the near, middle and far manifold components 13, 17 and 15 are integrated into the intake manifold 1. The intake manifold 1 is mounted on the engine E by fixing the flange 11 of the near manifold component 13 to the engine E.

The welding of the middle manifold component 17 to the near manifold component 13 may be performed after the welding of the far manifold component 15 to the middle manifold component 17. Or alternatively, the three manifold components 13, 15 and 17 may be welded at the same time.

According to this embodiment, where the intake manifold 1 is mounted on the engine E, the second path-forming parts 37 of the middle manifold component 17 are joined on the first path-forming parts 25 of the far manifold component 13. Therefore, the weight of the middle manifold component 17 is applied to press the second path-forming parts 37 against the first path-forming parts 25, i.e., it is not applied in such a direction that the path-forming parts 25 and 37 separate from each other. Thus, the welding strength between the first and middle manifold components 13 and 17 is ensured. Further, since the third path-forming parts 39 of the middle manifold component 17 and the fourth path-forming parts 45 of the far manifold component 15 constitute vertically curved portions of the intake paths 7, the welding interface between the path-forming parts 39 and 45 also extends in the vertical direction in a curve. Therefore, the weight of the far manifold component 15 is applied to shear the welding interface. As a result, unlike the conventional intake manifold in which the weight of the manifold component is applied to separate the welded manifold components, the obtained intake manifold 1 ensures the welding strength.

As described above, owing to the configuration of the three manifold components 13, 15 and 17, satisfactory welding strength is obtained among the manifold components 13, 15 and 17, thereby making the intake manifold 1 firm.

Further, in this embodiment, the intake manifold 1 is formed of the three manifold components 13, 15 and 17. Therefore, as compared with the conventional intake manifold including four manifold components as disclosed by Patent Literature 1 described above, parts count decreases and the number of manufacturing steps is reduced, thereby improving mass productivity.

Since the connection wall 47 of the far manifold component 15 is joined on the outer surface of the second tank part 31 of the middle manifold component 17 to provide a double layered structure, the throttle body mounting part 3 formed on the connection wall 47 increases in rigidity. Therefore, the throttle body mounting part 3 will not be broken even if a heavy throttle body is attached thereto.

Further, since the vertical cross section of the near manifold component 13 is substantially L-shaped, the near manifold component 13 increases in rigidity. This allows making the intake manifold 1 firmer.

(Embodiment 2)

Figure 7:
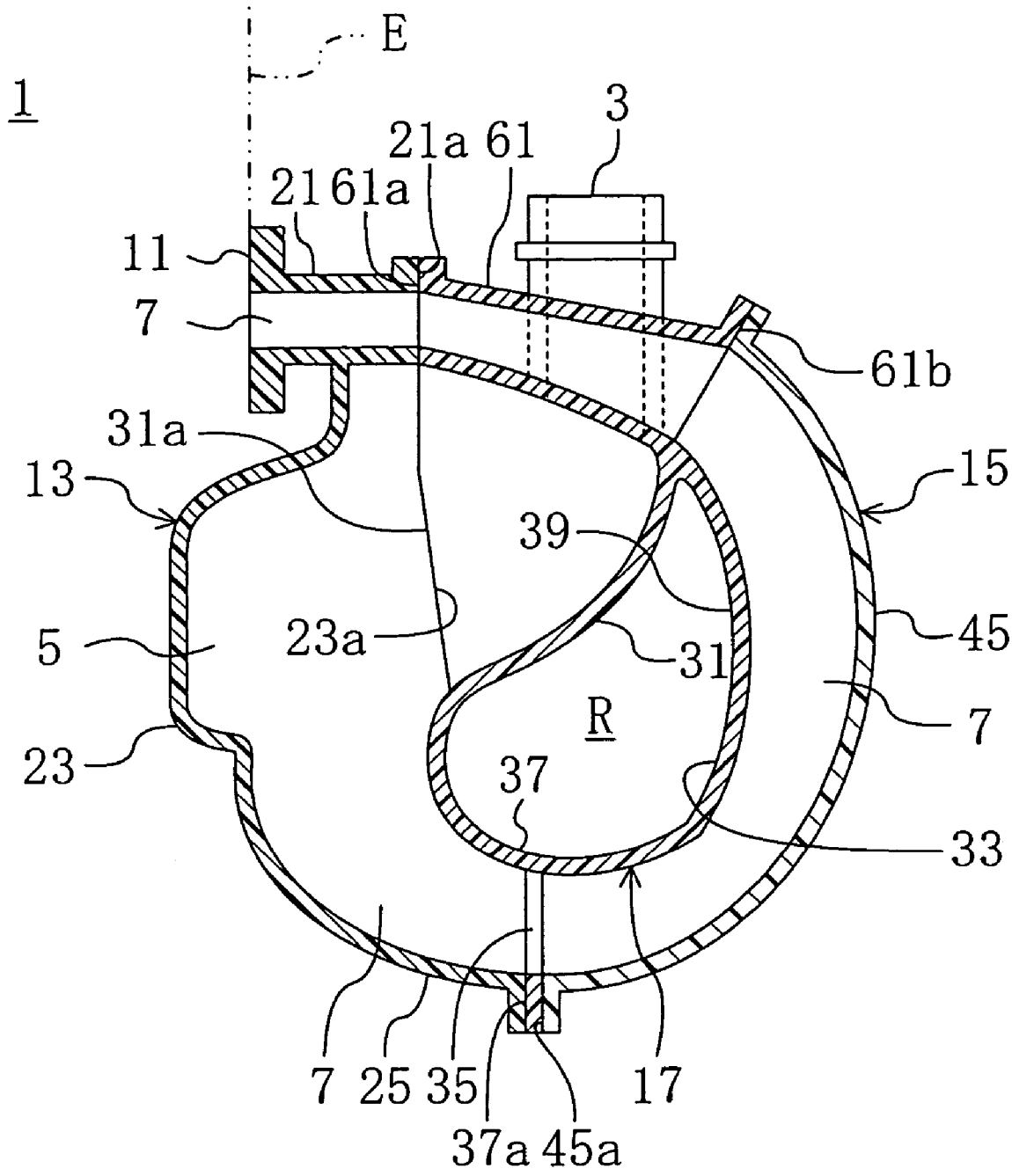
FIG. 7 is a view corresponding to FIG. 5 showing an intake manifold of Embodiment 2.

FIG. 7 is a view illustrating a resin intake manifold 1 for a multicylinder engine according to Embodiment 2 of the present invention. The intake manifold 1 of Embodiment 2 is different from that of Embodiment 1 in that the throttle body mounting part 3 is integrally formed with the middle manifold component 17. In the following explanation, the same components as those of Embodiment 1 are given with the same reference numerals used in Embodiment 1 and only the difference from Embodiment 1 is explained in detail.

The near manifold component 13 has first path-forming parts 25 which are shorter than those of the near manifold component 13 of Embodiment 1. The second path-forming parts 37 of the middle manifold component 17 are joined on and vibration-welded to the first path-forming parts 25.

Four cylindrical parts 61 are integrally formed at the upper part of the middle manifold component 17 to constitute the downstream sides of the intake paths 7. The cylindrical parts 61 are separated from each other in the direction of the arrangement of the intake paths 7 and the downstream ends thereof are communicated with the downstream end parts 21 of the near manifold component 13. At the ends of the cylindrical parts 61 near the downstream end parts 21, a welding plane 61*a* which is vibration-welded to the welding plane 21*a* of the downstream end parts 21 is provided. At the other ends of the cylindrical parts 61 opposite to the engine E, a welding plane 61*b* which is vibration-welded to the far manifold component 15 is provided.

Between the two inside ones of the four cylindrical parts 61 aligned in the direction of the arrangement of the intake paths 7, the throttle body mounting part 3 is arranged to extend in the vertical direction. The throttle body mounting part 3 is integrally formed with the top surface of the second tank part 31 of the middle manifold component 17. The lower end of the throttle body mounting part 3 is connected to the top surface of the surge tank 5 to form an opening through which the inside of the throttle body mounting part 3 communicates with the surge tank 5.

The third path-forming parts 39 of the middle manifold component 17 extend in the vertical direction in a curve in the same manner as those of Embodiment 1. In connection to this, the fourth path-forming parts 45 of the far manifold component 15 also extend in the vertical direction in a curve. Therefore, the welding interface between the third path-forming parts 39 and the fourth path-forming parts 45 also extends in the vertical direction in a curve.

According to the resin intake manifold 1 for a multicylinder engine of this embodiment, the welding strength among the manifold components 13, 15 and 17 is ensured and the resulting intake manifold 1 is made firm. In addition, since the intake manifold 1 is formed of the three manifold components 13, 15 and 17, the number of the manufacturing steps is reduced, thereby improving mass productivity.

In Embodiments 1 and 2 above, the intake manifold 1 including the four intake paths 7 is taken as an example, but the present invention is applicable to any intake manifold as long as two or more intake paths are provided.

Thus, as described above, the resin intake manifold for a multicylinder engine of the present invention is applicable to inline four-cylinder engines, for example.

What is claimed is:

1. A resin intake manifold for a multicylinder engine including a throttle body mounting part to which a throttle body is attached, a surge tank and intake paths which communicate with intake ports of the multicylinder engine, the throttle body, the surge tank and the intake paths being arranged in sequence along the direction of intake air flow, the intake paths extending in a curve from the bottom of the surge tank in the direction away from the engine and then upward to the intake ports of the multicylinder engine along the direction of the intake air flow, wherein the intake manifold comprises an assembly of separate components including: a near manifold component which is positioned near the engine; a far manifold component which is positioned at the side of the near manifold component opposite to the engine; and a middle manifold component which is positioned between the near and far manifold components, the near manifold component comprises a mounting part to be fixed to the engine, a first tank part which is positioned below the mounting part and constitutes part of the surge tank near the engine, and first path-forming parts which extend from the bottom of the first tank part in the direction away from the engine and constitute lower parts of the upstream sides of the intake paths, the middle manifold component comprises a second tank part which is joined to the side of the first tank part opposite to the engine to form the surge tank together with the first tank part, second path-forming parts which are joined on the first path-forming parts to form the upstream sides of the intake paths together with the first path-forming parts, and third path-forming parts which constitute engine-side parts of the downstream sides of the intake paths extending in the vertical direction in a curve to bulge in the direction away from the engine, the far manifold component comprises fourth path-forming parts which are joined to the sides of the third path-forming parts opposite to the engine to form the downstream sides of the intake paths together with the third path-forming parts, the middle manifold component or the far manifold component is formed integrally with the throttle body mounting part communicating with the surge tank, and the near manifold component, the middle manifold component and the far manifold component are integrated together such that the first and second tank parts are welded, the first and second path-forming parts are welded and the third and fourth path-forming parts are welded.

2. A resin intake manifold according to claim 1, wherein the intake paths are aligned in the direction of the arrangement of cylinders of the engine such that adjacent pairs of the intake paths are spaced from each other in the direction of the cylinder arrangement, the far manifold component is provided with a connection wall which connects the fourth path-forming parts forming the intake paths spaced from each other in the direction of the cylinder arrangement and the throttle body mounting part of cylindrical shape which penetrates the connection wall, and the connection wall is joined on the outer surface of the second tank part of the middle manifold component and the second tank part has an air inlet through which the inside of the throttle body mounting part communicates with the surge tank.

3. A resin intake manifold according to claim 1, wherein the vertical cross section of the near manifold component is substantially L-shaped.

4. A resin intake manifold according to claim 2, wherein the vertical cross section of the near manifold component is substantially L-shaped.

* * * * *